US005483721A

United States Patent [19]

Caldwell

[11] Patent Number: 5,483,721

[45] Date of Patent: Jan. 16, 1996

[54] SELF-CLEANING PAINT BRUSH

[76] Inventor: Donald L. Caldwell, 3425 Mission Mesa Way, San Diego, Calif. 92120

[21] Appl. No.: 364,801

[22] Filed: Dec. 26, 1994

Related U.S. Application Data

[63] Continuation-in-part of Ser. No. 116,679, Sep. 7, 1993, abandoned.

[51] Int. Cl.[6] ..... A46B 11/00; A46B 17/06

[52] U.S. Cl. ..... 15/160; 15/205.2; 401/282

[58] Field of Search ..... 15/104.92, 104.93, 15/104.94, 143.1, 160, 167.1, 171, 174, 186, 191.1, 207.2, 205.2, 159.1; 401/24, 268, 269, 282, 289, 283, 284, 285, 286, 287, 288, 290, 291; 248/110, 111, 112, 113

[56] References Cited

U.S. PATENT DOCUMENTS

| | | | |
|---|---|---|---|
| 172,432 | 1/1876 | Hellwig | 401/283 |
| 639,348 | 12/1899 | Roderick | 401/289 |
| 927,872 | 7/1909 | Price | 401/287 |
| 1,065,610 | 6/1913 | Hooker | 401/285 |
| 1,163,319 | 12/1915 | Campbell | 401/289 |
| 1,260,189 | 3/1918 | Grobe | 401/282 |
| 1,337,998 | 4/1920 | Church | 401/287 |
| 1,509,831 | 9/1924 | Gasparaitis | 401/285 |
| 1,571,338 | 2/1926 | Kratochvil | 401/284 |
| 1,631,560 | 6/1927 | Strubble et al. | 401/289 |
| 1,639,586 | 8/1927 | Boucher | 15/205.2 |
| 1,718,731 | 6/1929 | Crawford | 401/288 |
| 1,780,340 | 11/1930 | Cook | 401/160 |
| 1,860,277 | 5/1932 | Dennis | 401/287 |
| 1,928,929 | 10/1933 | Craig | 15/145 |
| 2,040,327 | 5/1936 | Olesen | 401/235 |
| 2,707,293 | 5/1955 | Ferrer | 401/289 |
| 3,022,789 | 2/1962 | Rallis et al. | 401/282 |
| 3,754,557 | 9/1973 | Moore | 401/289 |
| 4,589,791 | 5/1986 | Weihrauch | 401/284 |
| 4,676,685 | 6/1987 | Murphy | 401/285 |
| 4,916,773 | 4/1990 | McCoy | 401/284 |

FOREIGN PATENT DOCUMENTS

| | | | |
|---|---|---|---|
| 37327 | 4/1969 | Finland | 401/268 |
| 844787 | 7/1953 | Germany | 401/289 |
| 1038004 | 9/1958 | Germany | 401/289 |
| 215664 | 5/1924 | United Kingdom | 401/289 |
| 2212388 | 7/1989 | United Kingdom | 401/289 |
| 07340 | 10/1988 | WIPO | 401/286 |

*Primary Examiner*—David Scherbel
*Assistant Examiner*—Tony G. Soohoo

[57] ABSTRACT

A paint brush having a body, a handle connected to and extending outwardly from the body, a plurality of bristles arranged in a plurality of rows and extending outwardly from the body, a liquid inlet channel formed so as to extend through the body toward the plurality of bristles, and a plenum area formed in the body and connected to the liquid inlet channel. The plenum area has a plurality of outlet orifices formed therein adjacent to an end of the plurality of bristles. These outlet orifices are arranged in a rows between the plurality of bristles. The liquid inlet channel extends at an acute angle relative to a longitudinal axis of the handle. An adapter member is slidably received within the liquid inlet channel. The adapter member has a connector for attachment to an external source of liquid. The adapter member has a threaded end which tapers to an insert member. The insert member is slidably received within the liquid inlet channel.

17 Claims, 3 Drawing Sheets

SELF-CLEANING PAINT BRUSH

RELATED APPLICATIONS

The present application is a continuation-in-part of U.S. patent application Ser. No. 08/116,679, filed on Sep. 7, 1993, and entitled "SELF-CLEANING PAINT BRUSH", now abandoned.

TECHNICAL FIELD

The present invention relates to paint brushes. More particularly, the present invention relates to self-cleaning paint brushes whereby the paint on the bristles can be flushed and cleaned.

BACKGROUND ART

Paint brushes are widely known for the painting of surfaces and objects. Typically, a paint brush is used by placing the bristles of the paint brush into a container of paint. After the painting activity has been completed, it is necessary to clean the bristles of the paint brush. Often, the bristles are cleaned by inserting the bristles into a bucket of cleaning fluid or water. The cleaning of the paint brush is often a time consuming and tedious activity. Many times, the bristles are never cleaned to the satisfaction of the owner of the paint brush. Additionally, when the paint brush is placed into a bucket, only the outer surfaces of the bristles have direct contact with the water. The water, or other cleaning liquid, in the bucket, does not effectively penetrate or circulate throughout the bristles so as to maximize the ability to clean the bristles.

In the past, brushes of various types have utilized fluid connecting passages so as to enable paint to be directed through the brushes for various purposes. These prior art paint brushes have failed to utilize and orient such passages for receiving a water hose to enable the cleaning of the paint brush subsequent to its use in a painting operation.

U.S. Pat. No. 1,928,929, issued on Oct. 3, 1933 to C. F. Ceraig teaches a paint brush having a removable handle. When the handle is unscrewed from the body of the paint brush, an opening is provided so as to allow liquid to be inserted through orifices formed adjacent to the bristles. In this arrangement, cleaning fluid is forced through channels in areas adjacent to an end of the bristles.

U.S. Pat. No. 2,126,199, issued on Aug. 16, 1938, to H. F. Mitchell teaches a paint brush in which paint can be fed, under pressure, through the handle of the brush, through a longitudinal channel, and into an area amongst the bristles extending outwardly from the body.

U.S. Pat. No. 2,806,236, to Stefano sets forth a rotary painting brush wherein a hose arrangement is formed through a rear handle portion of the paint brush to provide both rotary movement and impart fluid to the bristles of the paint brush to effect a painting operation.

U.S. Pat. No. 3,509,872, to Stillman sets forth a dental cleansing and massaging apparatus wherein fluid is directed orthogonally into an elongate body of the device to effect a rotary operation of the various tools utilized at opposite ends of the body member.

U.S. Pat. No. 3,603,694, issued on Sep. 7, 1971, to R. D. Hamm describes a pistol-type handle on the end of a hollow hub affixed to the bristles of a paint brush. A trigger-actuated mechanism is provided so as to pump paint between the bristles of the paint brush. The handle and the pumping device are connected by a flexible hose to a portable paint container.

U.S. Pat. No. 4,175,300 to McGlew et al. sets forth a paint roller construction wherein paint is directed through the elongate handle and body portion of the roller, and directed through the roller so as to direct paint through the roller and onto a surface to be painted.

U.S. Pat. No. 4,660,244 to Poliak sets forth a hydraulic tooth and gum cleaning device utilizing liquid Jets to supply a rotary motion to the tool and direct such fluid onto associated teeth and gums.

U.S. Pat. No. 4,676,685, issued on Jun. 30, 1987, to E. P. Murphy describes a power brush coating applicator having a separable handle, a valved housing and a brush housing. The handle of the applicator is adapted for connection to a source of pressurized liquid. An interior flow path is provided through the valve chamber and into flow communication with the capillary openings adjacent to the bristles.

International Publication No. WO 88/0734, published on Oct. 6, 1988, to Varrichione provides a detachable manifold and brush assembly having a bristle head with a detachable manifold having a feed port. A distribution channel communicates with the feed port. Feed conduits are provided so as to distribute paint to the bristles. The bristle heads and the manifold are removably secured together.

It is an object of the present invention to provide a paint brush that can be easily and thoroughly cleaned during a painting operation.

It is another object of the present invention to provide a self-cleaning paint brush that allows the cleaning liquid to be evenly distributed throughout the bristles.

It is a further object of the present invention to provide a self-cleaning paint brush in which the source of liquid can be disconnected as required.

It is still a further object of the present invention to provide a self-cleaning paint brush which is easy to use, easy to manufacture, and relatively inexpensive.

It is another object of the present invention to provide a self-cleaning paint brush that minimizes the amount of water required for cleaning the brush.

It is another object of the present invention to provide a self-cleaning paint brush that increases the life of the brush.

It is a further object of the present invention to provide a self-cleaning paint brush that reduces the cost of brushes to painters.

It is another object of the present invention to provide a self-cleaning paint brush that reduces labor costs.

It is another object of the present invention to provide a self-cleaning paint brush that reduces waste and minimizes disposal problems.

These and other objects and advantages of the present invention will become apparent from a reading of the attached specification and appended claims.

SUMMARY OF THE INVENTION

The present invention is a paint brush that comprises a body, a handle connected to and extending outwardly from the body, a plurality of bristles arranged in a plurality of rows and extending outwardly from the body, a liquid inlet channel formed so as to extend through the body toward the plurality of bristles, and a plenum area formed in the body and connected to the liquid inlet channel. The plenum area has a plurality of outlet orifices formed therein adjacent an end of the plurality of bristles. The outlet orifices are arranged in rows between the plurality of bristles.

The liquid inlet channel is arranged separate from the handle. The handle is nonremovably connected to the body. The plurality of bristles are affixed to the body adjacent to the plenum area. The outlet orifices are positioned between the plurality of rows of bristles. The outlet orifices are tubes that extend into the plenum area and open to the bristles. A bar is affixed to an end of the body. The ends of the bristles are affixed to the bar. The tubes open through the bar. The liquid inlet channel has one end opening along an exterior surface of the body separate from the handle. The liquid inlet channel has another end opening to the plenum area. The liquid inlet channel extends at an acute angle relative to the longitudinal axis of the handle.

In one embodiment, an adapter member can be slidably received within the liquid inlet channel. This adapter member has a connector for attachment to an external source of liquid. The connector has a threaded end. The adapter member tapers from the connector to an insert member. The insert member is slidably received within the liquid inlet channel. The connector has a greater inner diameter than the insert member. The adapter member opens at an end opposite to the connector. The end is received within the plenum area. The inlet channel includes a tubular member that is fitted within a hole formed in the body.

DETAILED DESCRIPTION OF THE INVENTION

Figure 1:
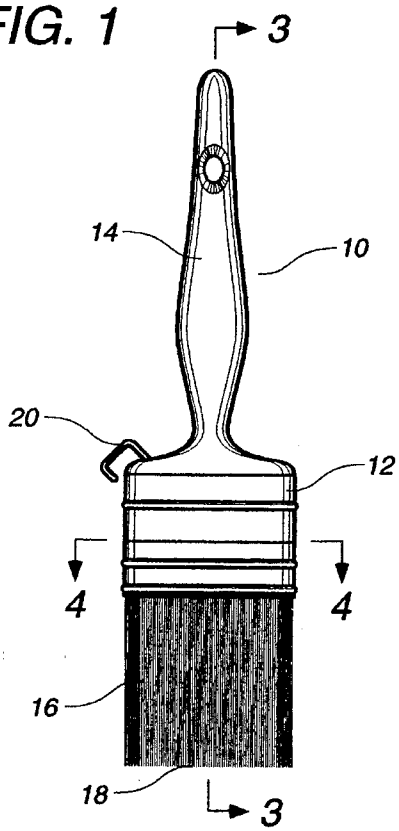
FIG. 1 is a front elevational view of the paint brush in accordance with the present invention.

Referring to FIG. 1, there is shown at 10 the self-cleaning paint brush in accordance with the present invention. The paint brush 10 includes a body 12 having a handle 14 extending outwardly therefrom. A plurality of bristles 16 are arranged in a plurality of rows and extend outwardly from the body 12. As can be seen in FIG. 1, the paint brush 10 resembles a conventional paint brush.

Specifically, in FIG. 1, it can be seen that the handle 14 is nonremovably connected to, or integrally formed with, the body 12. The combination of the body 12 and the handle 14 defines a longitudinal axis extending through the paint brush 10. The bristles 16 extend outwardly from the end of the body 12 so as to form an end surface 18 suitable for the receipt of paint thereon.

In FIG. 1, it can be seen that a clip 20 is affixed to an exterior surface of the body 12 and extends outwardly therefrom. This clip 20 is a spring-type of clip for detachably securing the body 12 to an edge of a paint bucket. Various configurations of clip 20 can be used within the scope of the present invention. It is intended that the clip 20 be attached to the body 12 so as to allow the paint brush 10 to be supported within a paint bucket.

Figure 2:
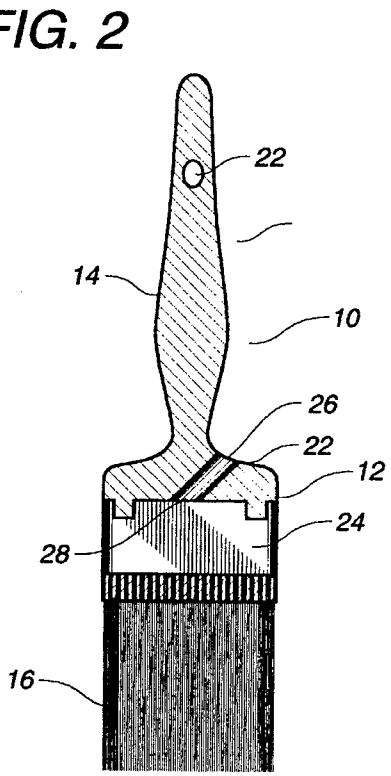
FIG. 2 is a cross-sectional view of the paint brush of the present invention as taken across lines 2—2 of FIG. 3.

FIG. 2 is a cross-sectional view of the paint brush 10. It can be seen in FIG. 2 that the handle 14 is a solid member that is integrally formed with the body 12. A hole 22 is formed at an end of the handle 14 so as to allow the handle to be properly hung on a hook or other support. In FIG. 2, it can be seen that a liquid inlet channel 22 is formed in the body 12 so as to extend through the body 12 toward the plurality of bristles 16. A plenum area 24 is formed in the body 12 and is connected to the liquid inlet channel 22. As will be described hereinafter, the plenum area 24 has a plurality of outlet orifices which are formed adjacent to an end of the plurality of bristles 16. The outlet orifices are arranged in a plurality of rows between the plurality of bristles 16.

It can be seen in FIG. 2 that the liquid inlet channel 22 is separated from the handle 14. This allows the paint brush to be utilized in the manner of a conventional paint brush, when cleaning is not required. There is no need to unscrew the handle, or otherwise manipulate the handle for the purposes of the cleaning activity. Since a large amount of force is applied to the handle during the painting activities, it has been determined that it is wise not to sacrifice the integrity of the handle 14 for the inclusion of a liquid inlet channel. Additionally, the shorter the length of the inlet channel 22, the easier it is to "pump in" large amounts of cleaning fluid.

It can be seen that the plurality of bristles 16 are affixed to the body 12 adjacent to the plenum area 24. The liquid inlet channel 22 has one end 26 opening along an exterior surface of the body 12. The liquid inlet channel 22 has another end 28 opening to the plenum area 24. The liquid inlet channel 22 is configured so as to extend at an acute angle relative to the longitudinal axis of the handle 14. The novel use of this acute angle arrangement allows the liquid inlet channel 22 to be conveniently connected to a water outlet, such as a faucet or hose. The use of the inlet channel 22, in the configuration shown in FIG. 2 also allows the paint brush to assume its "self-cleaning" mode without the for attachment to a water outlet. After experimentation, it has been found that the paint brush of the present invention can be effectively cleaned by simply dipping the paint brush into a bucket of water. Whenever the paint brush is dipped into the bucket of water, the water will flow into the inlet channel 22 and into the plenum area 24. As a result, water will flow from the outlet orifices so as to effectively clean the end of the bristle 16 adjacent to the outlet orifices. While this is occurring, the dipping of the paint brush 10 into the bucket of water will also clean the remaining portions of the bristles 16. The cleaning of the ends of the bristles adjacent to the plenum area 24 effectively eliminates the build-up of paint in the bristles at the base of the body of the brush. The configuration of the present invention effectively cleans the entire length of the bristles 16.

Figure 3:
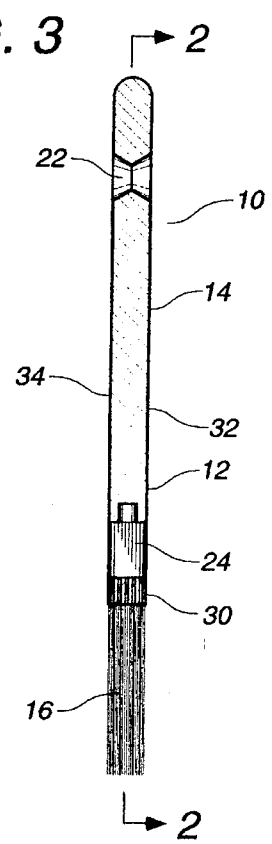
FIG. 3 is a cross-sectional view of the paint brush of the present invention as taken across lines 3—3 of FIG. 1.

In FIG. 3, it can be seen that the handle 14 extends integrally upwardly from the body 12. The bristles 16 are shown as arranged in a plurality of rows which extend from the end 30 of body 12 adjacent to the plenum area 24. The plenum area 24 extends across from one side 32 to the other side 34 of the brush 10. The configuration of the plenum area 24 has a plurality of outlet orifices that are arranged between the rows of the bristles 16.

Figure 4:
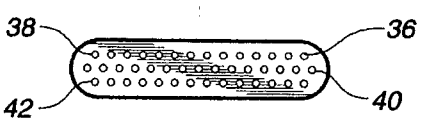
FIG. 4 is a cross-sectional view of the paint brush of the present invention as taken across lines 4—4 of FIG. 1.

FIG. 4 shows the arrangement, of the outlet orifices 36 formed at the bottom of the plenum area 24. It can be seen that the outlet orifices 36 are arranged in three rows 38, 40, and 42. Each of the orifices 36 has a very small diameter. The small diameter of the orifices 36 allows water to pass therethrough under extremely high pressures, by way of a venturi-type effect. In normal use, the tufts of bristles will be positioned between the rows 38 and 40 or between the rows 40 and 42. The bristles can also be arranged on the far sides of rows 38 and 42. Although FIG. 4 shows three rows of orifices 36, it should be kept in mind that, within the scope of the present invention, any number of rows can be formed on the plenum area 24 so as to accommodate the size of brush utilized. Each of the rows 38, 40, and 42 has multiple orifices formed therealong. The orifices extend in a linear pattern across the rows.

Figure 5:
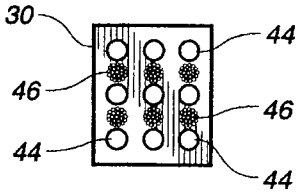
FIG. 5 is a magnified view of the arrangement of tufts and orifices of the paint brush of the present invention.

FIG. 5 is a magnified view showing the arrangement of the orifices 44 and the tufts of bristles 46. It can be seen that the outlet orifices 44 are arranged in a plurality of rows between the plurality of bristles. Each of the plurality of bristles is arranged in separated tufts 46 extending across an end 30 of the body 12. The orifices 44 are positioned between adjacent pairs of the separated tufts 46. This arrangement of tufts and outlet orifices allows for a complete circulation of the cleaning fluid throughout the interior area of the bristles 16. As such, the present invention effectively cleans the bristles of the paint brush 10 whenever the cleaning liquid is introduced into the liquid inlet channel 22 and into the plenum area 24.

Figure 6:
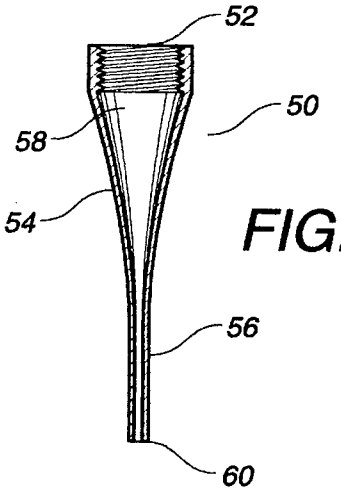
FIG. 6 is a cross-sectional view of one adapter member as used with the paint brush of the present invention.

The present invention utilizes an adapter member for the purpose of introducing the cleaning liquid into the plenum area 24. Two embodiments of the adapter member are described hereinafter. in FIG. 6, the adapter member 50 is configured for connection to a garden hose. Specifically, the adapter member 50 has a threaded connector end 52 for attachment to the external source of liquid. As can be seen, the connector 52 has an internal thread. The internal thread of connector 52 will engage an external thread of a garden hose, or an outdoor faucet. The body 54 of adapter member 50 tapers from the threaded connector end 52 to the insert portion 56. The insert portion 56 is configured and sized so as to be snugly received within the liquid inlet channel 22. The outer diameter of the insert member 56 will generally match the inner diameter of the liquid inlet channel 22. As can be seen, the interior passageway 58 for the cleaning liquid tapers from the connector 52 toward the outlet end 60. This tapering of the internal passageway 58 causes liquid to pass, under pressure, from the source of the cleaning liquid to the outlet end 60. This facilitates the ability to cause the liquid to pass, under pressure, through the outlet orifices.

Figure 7:
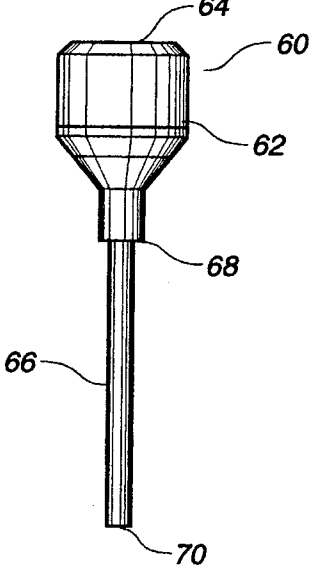
FIG. 7 is a side elevational view of another adapter member of the present invention.

FIG. 7 is an exterior view of an alternative embodiment 60 of the adapter member. This alternative embodiment 60 allows the paint brush 10 of the present invention to be connected to a faucet for the purposes of cleaning. It can be seen that this adapter member 60 has a connector end 62 that is specifically configured so as to go around the exterior surface of a faucet. The connector 62 is made of a polyurethane material. The open end 64 will fit around the outer diameter of the faucet in a secure liquid-tight fashion. The insert member 66 extends downwardly from the bottom 68 of the connector 62. The insert member 66 is configured so as to have an outer diameter which matches the inner diameter of the inlet channel 22. Any liquids entering the opening 64 of the connector 62 will exit through the outlet 70 at the end of the insert member 66. The insert member 66 will, conventionally, be a nylon tube.

Figure 8:
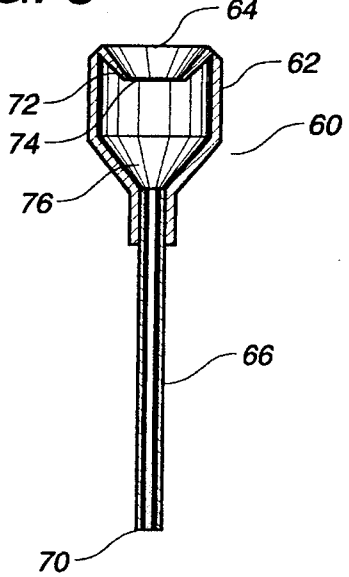
FIG. 8 is a cross-sectional view of the adapter member shown in FIG. 7.

FIG. 8 is a cross-sectional view of the adapter member 60 as shown in FIG. 7. Specifically, the adapter member 60 has a connector 62 and an insert member 66. The open end 64 of the connector 62 has inwardly tapering surfaces 72. These inwardly tapering surfaces have a generally frustoconical configuration. This configuration opens at interior end 74. The frustoconical configuration 72 allows the open end 64 to be adapted to various configurations, sizes, and shapes of faucets. An interior area 76 accepts the flow of cleaning liquid therein and passes the flow into the insert member 66.

Figure 9:
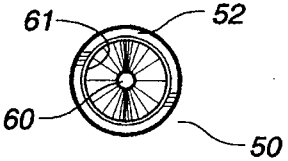
FIG. 9 is a top view of the adapter member of the present invention.

FIG. 9 shows that the adapter member 50 has a generally circular top surface 52. The outlet 60 is centered relative to the end 52. The threads 61 are formed interior of the connector end 52.

Figure 10:
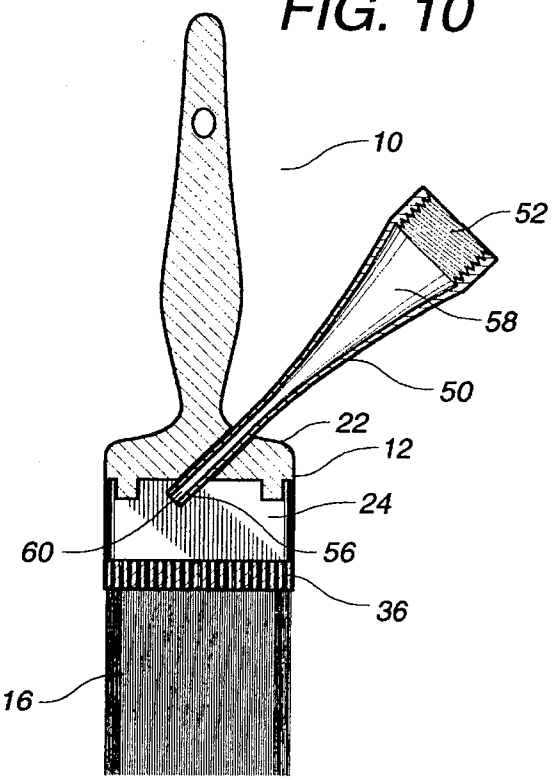
FIG. 10 is a cross-sectional view of the self-cleaning paint brush of the present invention as shown with the adapter member inserted into the liquid inlet channel.

FIG. 10 shows the self-cleaning paint brush 10 as utilized in conjunction with the adapter member 50. It can be seen that the adapter member 50 has its insert member 56 slidably received within the inlet channel 22. The outlet 60 is positioned within the plenum area 24 of the body 12 of brush 10. When the connector end 52 is attached to a garden hose (or faucet), water is pumped into the interior 58 and outwardly through the outlet 60. This serves to fill the plenum area 24 with the cleaning liquid. As pressure is built up within the plenum area 24, the cleaning liquid will pass outwardly through the orifices 36 adjacent to the bristles 16. After the bristles 16 have been properly cleaned, then the adapter member 50 can be slidably removed from the liquid inlet channel 22. Any excess liquids found in the plenum area 24 can be easily emptied through the liquid inlet channel 22 or will pass through the orifices 36.

The configuration of the present invention allows the paint brush 10 be utilized as a conventional paint brush. However, when it is necessary to clean the brush 10, the configuration of the adapter member 50 and the inlet channel 22 allows water to be introduced into, around, and throughout the plurality of bristles 16. As such, the self-cleaning paint brush 10, of the present invention, can effectively remove paint from all of the surfaces of the bristles 16.

Figure 12:
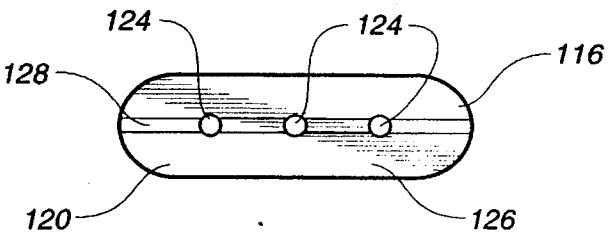
FIG. 12 is a cross-sectional view taken across lines 12—12 of FIG. 11.
Figure 11:
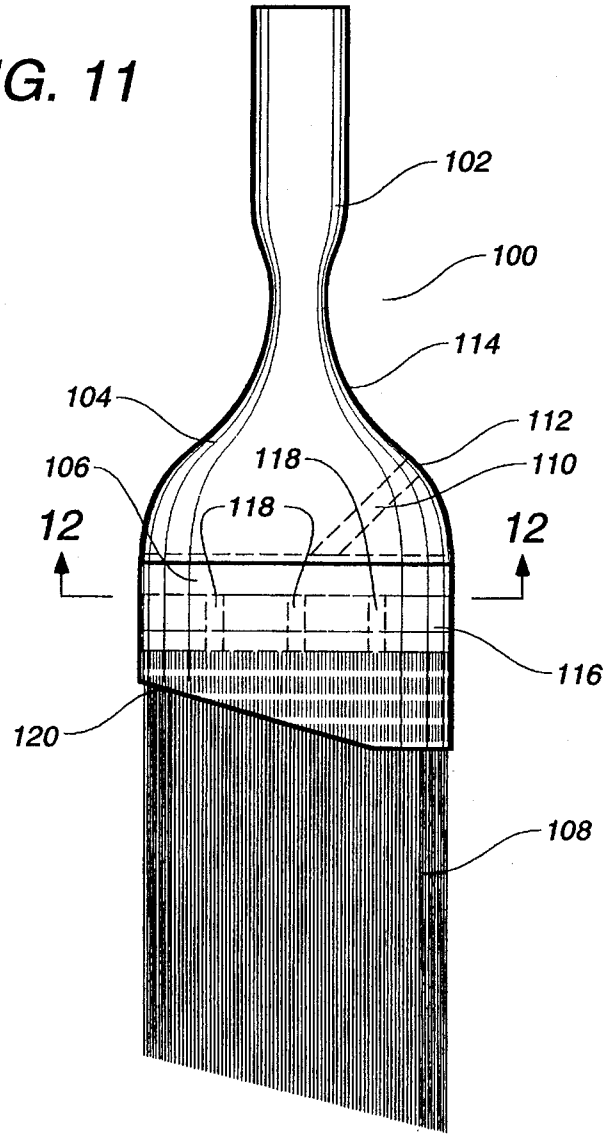
FIG. 11 is a side elevational view of the paint brush in accordance with the preferred embodiment of the present invention.

FIGS. 11 and 12 show the preferred embodiment of the present invention. In the preferred embodiment of the present invention, the brush 100 includes a handle 102, a body 104, a plenum area 106, and a plurality of bristles 108. The handle 102 and the body 104 are made of a conventional wood material. A hole 110 is formed in the body 104. A plastic tube 112 is inserted within the hole 110 so as to form the liquid inlet of the present invention. The plastic tube 112 will extend from the exterior surface 114 of the body 104 so as to open to the plenum area 106. A plastic bar 116 is affixed to the body 104 at the bottom of the plenum area 106. The plastic bar 116 extends across the plenum area 106 so as to define the liquid-receiving volume of the plenum area 106. The plastic bar 116 includes plastic tubes 118 which extend through the plastic bar 116 and open to the end of the bristles 108 adjacent to the plenum area 106. A stainless steel band 120 is affixed to the exterior surface of the body 104 and extends over the plenum area 106, over the plastic bar 116, and over an end of the bristles 108. The stainless steel band 120 further defines the plenum area 106 and serves to secure the plastic bar 116 in place. The stainless steel band 120 will also cause the bristles 108 to be properly contained within the area of the body 104. As shown in FIG. 11, the stainless steel band 120 is shown in a transparent manner so that the configuration of the bristles 108 in combination with the plastic bar 116 can be seen.

The ends of the bristles 108 are glued to the bottom surface of the plastic bar 116. This serves to effectively secure the bristles in their proper positions.

FIG. 12 shows the plastic bar 116. It can be seen that the plastic tubes 118 are received within holes 124 formed in the plastic bar 116. The holes 124 extend in a linear pattern across a center of the plastic bar 116. The holes 124 will communicate with the plenum area 106 so as to allow water in the plenum area 106 to pass to the ends of the bristles 118 contained within the steel band 120.

In order to attach the bristles 108, glue is applied to the surface 126 of the plastic bar 116. The ends of the bristles can then be applied in tufts to the surface 126. It can be seen that the steel band 120 extends around the exterior of the bar 116. A support member 128 can extend along the center of the bar 116 so as to create the pocket for the bristles and to allow for the formation of the angle of the bristles.

The embodiment of FIGS. 11 and 12 does not require the application of the adapter member of the previous embodiment. However, such an adapter member could also be used with the embodiment shown in FIGS. 11 and 12. In normal use, a cleaning bucket is filled with water to a level higher than the hole 110 in the body 104 when the brush 100 is sitting freely in the bucket. Soap can then be added to the water in the bucket. The brush is submerged in the water. The bristles can then be combed or wire brushed so as to remove dried paint from the bristles. The brush 100 can then be plunged into and out of the water several times. The bucket can then be filled and refilled with clean water, as required.

So as to assure effective cleaning, the handle 102 should be placed between the user's hands. A spinning action will then cause the bristles to be spun dry. The cleaned bristles of the brush can then be placed in a jacket or keeper.

The embodiment of FIGS. 11 and 12 significantly reduces the amount of cleanup time. The brush in accordance with the embodiment of FIGS. 11 and 12 can be cleaned in three to five minutes in comparison with twenty-five to thirty minutes for conventional brushes. The brush of the present invention can be cleaned by using three gallons of water, in comparison with eight gallons for conventional brushes. The brushes of the present invention have been found to last sixty working days, in comparison to twenty working days for conventional brushes. Overall, this serves to significantly reduce the cost of the brushes. Additionally, labor costs associated with the cleaning of the brushes is significantly reduced. It has been found that the brushes of the present invention can be taken back to the work area within minutes after cleaning. After spinning the brush, in the manner described hereinbefore, water will not be retained in the bristles. The holes formed in the plenum area and in the bar serve to unexpectedly create ventilation and, hence, quick drying. The bristles 108 can be dry within one minutes after spinning.

The ability of the brush of the present invention to have a longer life greatly reduces the amount of waste and disposal requirements. The use of the plastic bar, the steel band, and the properly arranged bristles enormously increases the manufacturing efficiency for the brush.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A paint brush assembly comprising:

a body;

a handle connected to and extending outwardly from said body;

a plurality of bristles arranged in a plurality of rows, said bristles extending outwardly from said body in parallel alignment with a longitudinal axis of said handle;

a liquid inlet channel formed so as to extend through said body toward said plurality of bristles, said liquid inlet channel formed solely within said body, said liquid inlet channel extending at an acute angle relative to a longitudinal axis of said handle, said liquid inlet channel being uncovered and having an unrestricted flow passageway along an entire length of said liquid inlet channel, said liquid inlet channel having one en opening along an exterior surface of said body;

a plenum area formed in said body and in communication with said liquid inlet channel, said plenum area extending substantially across a width of said body, said plenum area having a plurality of outlet orifices formed therein adjacent an end of said plurality of bristles, said outlet orifices arranged adjacent said plurality of bristles, said liquid inlet channel having another end opening to said plenum area; and an adapter member slidably and detachably received within said liquid inlet channel, said adapter member having a connector for selective attachment to an external source of liquid.

2. The paint brush assembly of claim 1, wherein said plurality of bristles are affixed to said body adjacent said plenum area.

3. The paint brush assembly of claim 2, wherein each said plurality of outlet orifices comprises a tube extending from said plenum area to said plurality of bristles.

4. The paint brush assembly of claim 3, wherein said plurality of bristles are affixed to a bar extending across a bottom end of said body, said tube extending through said bar.

5. The paint brush assembly of claim 1 wherein said liquid inlet channel is a tubular member fitted within a hole formed in said body.

6. The paint brush assembly of claim 1, wherein said connector has a threaded end, said adapter member tapering from said connector to an insert portion, said insert portion slidably received within said liquid inlet channel.

7. The paint brush assembly of claim 6, wherein said connector has a greater inner diameter than said insert portion, said adapter member having an end opposite said connector extending into said plenum area.

8. The paint brush assembly of claim 6, further comprising:

a rigid band extending across said plenum area and around said plurality of bristles, said rigid band affixed to an exterior surface at said body and extending downwardly therefrom.

9. The paint brush assembly of claim 1, said plurality of outlet orifices extending in a linear row across a bottom of said plenum area, said plurality of orifices positioned centrally of said plenum area.

10. A paint brush assembly comprising:

a body;

a uncovered liquid inlet channel formed solely within said body, said inlet channel having an unrestricted flow passageway;

a plenum area formed in said body and communicating with said liquid inlet channel, said plenum area extending substantially across a width of said body, said inlet channel opening to said plenum area;

a plurality of bristles affixed to an end of said body adjacent said plenum area, said plenum area having a plurality of orifices opening toward said bristles, each of said plurality of orifices being a tube having one end opening to an interior of said plenum area and extending downwardly therefrom; and a handle extending outwardly from said body opposite said plurality of bristles, said liquid inlet channel extending at an acute angle relative to said handle, said bristles extending outwardly from said body in generally parallel alignment with a longitudinal axis of said handle.

11. The paint brush assembly of claim 10, wherein said body has a bar extending thereacross at a bottom of said plenum area, said plurality of bristles affixed to said bar.

12. The paint brush assembly of claim 11, said bar and said plenum area defining a liquid-receiving volume.

13. The paint brush assembly of claim 12, wherein said plurality of orifices extend through said bar such that an end of said tube is adjacent an end of said plurality of bristles.

14. The paint brush assembly of claim 10, further comprising:

an adapter member removably received within said liquid inlet channel, said adapter member having a connector for attachment to an external source of liquid.

15. The paint brush assembly of claim 14, said connector having a threaded end, said adapter member tapering from said connector to an insert portion, said insert member slidably received within said liquid inlet channel.

16. The paint brush assembly of claim 15, wherein said connector has a greater inner diameter than said insert portion, said adapter member having an end received within said plenum area.

17. The paint brush assembly of claim 10, wherein said liquid inlet channel is a tubular member fitted within a hole formed in said body.

* * * * *